United States Patent [19]

Tsai

[11] 4,240,454

[45] Dec. 23, 1980

[54] AUTOMATIC UMBRELLA

[76] Inventor: Kuo L. Tsai, No. 106, Yung Chen Rd., Yung Ho Chen, Taipei Hsien, Taiwan

[21] Appl. No.: 964,476

[22] Filed: Nov. 29, 1978

[51] Int. Cl.[2] ..... A45B 25/16

[52] U.S. Cl. ..... 135/24

[58] Field of Search ..... 135/22, 23, 24, 20 R

[56] References Cited

U.S. PATENT DOCUMENTS

| | | | |
|---|---|---|---|
| 1,844,325 | 2/1932 | Killebrew | 135/22 |
| 3,161,990 | 12/1964 | Morris | 135/23 |
| 4,041,966 | 8/1977 | Sakurai | 135/22 |

*Primary Examiner*—Reinaldo P. Machado

*Attorney, Agent, or Firm*—Shoemaker and Mattare, Ltd.

[57] ABSTRACT

The invention relates to an improved automatic umbrella which comprises a tapered contracting cylinder at the uppermost portion thereof, a controlling tube at the middle portion thereof and a controlling lever at the lower portion thereof. Besides, the invention also comprises a set of spokes fixed on to the spoke hub of the controlling tube and a coil spring, one end thereof being homed within the tapered contracting cylinder while the other end thereof being resistant against the spoke hub. The controlling tube has an inward concave portion longitudinally provided with several holes in line for adjusting the tensity of the umbrella cloth. The controlling tube is provided with a top projecting piece, an interim projecting piece and a push button.

5 Claims, 5 Drawing Figures

AUTOMATIC UMBRELLA

BACKGROUND OF THE INVENTION

The conventional automatic umbrella as well as non-automatic umbrella employs more than a coil spring to facilitate the unfolding and collapsing of the umbrella. And the way thereof to dispose the coil springs is by means of connecting, in the case of which the number of connecting point is consequently increased. As a result, the connecting points in numbers will decrease the durability of the umbrella, but also heighten the cost thereof.

Besides, the conventional arts concerned employ more than a set of spokes to prop up the unfolded umbrella. The trouble is, that the cost is heightened and the time for manufacturing thereof is wastefully lengthened.

Apart from the drawbacks abovementioned, the conventional arts concerned have also others. For example, they have as yet no provision of a device to prevent the turning inside out thereof and no provision of a device to adjust the tensity of the umbrella cloth.

BRIEF SUMMARY OF THE INVENTION

Accordingly, it is an object of the invention to provide an improved automatic umbrella employing only a coil spring to facilitate the unfolding and collapsing of the invention.

It is another object of the invention to provide an improved automatic umbrella having only a set of spokes, which is comparatively decreased in number.

It is another object of the invention to provide an improved automatic umbrella having the provision of a device to adjust the tensity of the umbrella cloth and prevent the turning inside out thereof.

It is still another object of the invention to provide an improved automatic umbrella which is mechanically simple, and inexpensive to manufacture.

BRIEF DESCRIPTION OF THE DRAWING

Other purposes and advantages will become apparent as the invention is now described in detail with reference to the appended drawings, wherein.

DETAILED DESCRIPTION OF THE INVENTION

Figure 1:
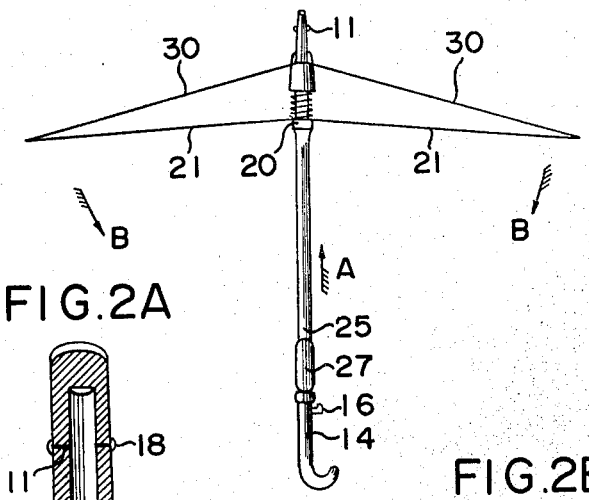
FIG. 1 is a block diagram of the invention.
Figure 2A:
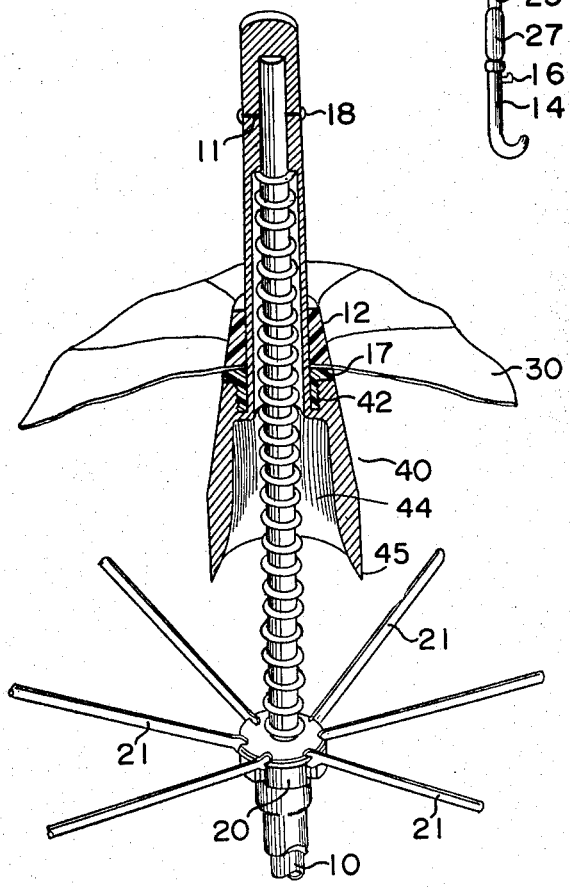
FIG. 2A is a partly sectional view of the invention in unfolded position, wherein the umbrella cloth, the spokes, the main stem and the controlling tube are partly taken away, besides, the tapered contracting cylinder and the fixing member thereupon are longitudinally sectionalized.
Figure 3A:
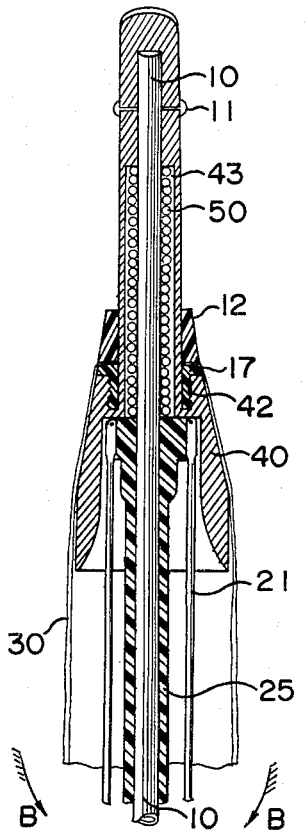
FIGS. 3A and 3B are the longitudinal section of the invention in collapsed position.

As shown in FIGS. 2A and 3A, the invention is provided with a tapered contracting cylinder 40 at the uppermost portion thereof. Said tapered contracting cylinder 40 is hollow in construction, having the provision of a rivetting hole 11 horizontally therethrough the upper portion and a female screw 42 at the middle portion thereof. Besides, at the lowermost portion of said tapered contracting cylinder 40, there is further provided an expansion 45 with a divergent inside 44. Said female screw 42 is thus provided to be screwed therein by a male screw 17 whereby the tensity of the umbrella cloth 30 is adjustable. And upon said male screw 17, a fixing member 12 of elastic material is yet further provided to perform the fixation of said umbrella cloth 30 therebetween. With regard to the construction of said tapered contracting cylinder 40, there is one more thing to be observed, though not essential, that as shown in FIGS. 2A and 3A, the uppermost portion is thicker than the middle portion thereof so that a coil spring 50 provided therein can be resisted.

Figure 2B:
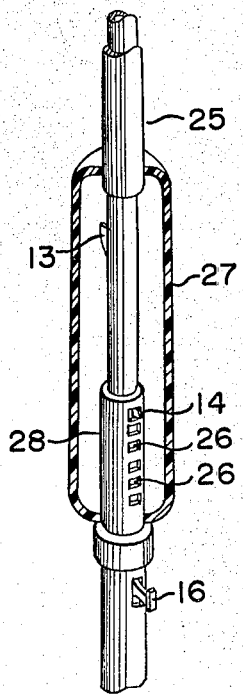
FIG. 2B is a partly sectional view of the invention in unfolded position to depict the lower portion under the spoke hub thereof, wherein the integral expanded portion of the controlling tube is longitudinally sectionalized.
Figure 3B:
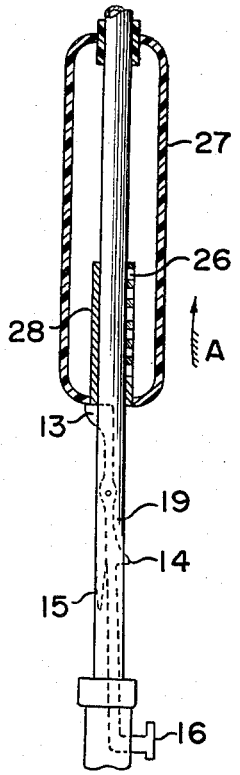

As shown in FIGS. 2A, 2B, 3A and 3B, under said tapered contracting cylinder 40, a controlling tube 25 is provided, both permitting the insertion of a main stem 10 therein. The uppermost portion of said controlling tube 25 is a spoke hub 20, while the lower and lowermost portions thereof is an expansion 27. Radially upon the rim of said spoke hub 20, a plurality of spokes 21—21 each with one end are pivoted, the other ends of said spokes 21—21 being connected on to the rim of said umbrella cloth 30. As indicated in FIGS. 2A and 3A, said main stem 10 is fastened on to said tapered contracting cylinder 40 by means of a rivet 18 and between said spoke hub 20 and said tapered contracting cylinder 40, said coil spring 50 is provided. Inside the lower portion of said expansion 27, as seen in FIGS. 2B and 3B, an inner tube 28 with several holes 26—26 longitudinally arranged in line is provided. Also as seen in FIG. 3B, a controlling lever 19 is provided inside and meantime fastened on to said main stem 10. Said controlling lever 19 is thus constructed that its uppermost portion is a top projecting piece 13, the top thereof being flat while the portion under the top thereof being converged downward; its middle portion is an interim projecting piece 14, the bottom thereof being flat while the portion thereabove being converged upward; its bottom portion is a push botton 16. And also inside said main stem 10, a spring 15 is provided behind the lower portion of said controlling lever 19. To correspond to the construction of said controlling lever 19, three holes are respectively provided through said main stem 10 and the handle 14 for said top projecting piece 13, said interim projecting piece 14 and said push botton 16 to freely slide therethrough. (no reference numbers are given to said three holes in FIGS.)

On the one hand, in a case where the invention in collapsed position is to be unfolded, push said push button 13 and then said controlling tube 25 will withdraw to bring about the unfolding of said spokes 21—21 and said umbrella cloth 30 by the way that said coil spring 50 compressed is, as a result, released to furnish a downward pressure directly upon said spoke hub 20. In the opened position, said interim projecting piece 14 can be as desired fixed within any one of holes 26—26 to abviate the possibility that said umbrella cloth may be turned inside out. On the other hand, while the umbrella in unfolded position is to be folded up, push said expansion 27 of said controlling tube 25 in the direction as the arrow A in FIG. 3B shows, and then said divergent inside 44 of said tapered contracting tube 40 will facilitate the collecting up of said spokes 21—21 within the expansion 45 of said tapered contracting tube 40 until said top projecting piece 13 is located under the bottom of said expansion 27. By means of the resistance of said top projecting piece 13 against the bottom of said expansion 27, the invention will stay in a collapsed position.

The invention has four features which distinguishes over the conventional umbrella, that firstly, the invention has only one set of spokes 21—21, however it has no spokes, as required in conventional umbrella, attatched on to the plane of the umbrella cloth; secondly, the invention has the provision of holes 26—26 to adjust the tensity of the umbrella cloth or the scale thereof; thirdly, the invention employs a novel way to fold up the umbrella, the direction thereof being totally contrary to the conventional one; fourthly, in folding up of the invention, the route of the manual operation is shorter than the conventional one.

We claim:

1. An improved automatic umbrella comprising:

a tapered contracting cylinder at the uppermost portion thereof, its lower portion being an expansion which has an outward divergent inside surface;

a fixing member fastened around said tapered contracting cylinder;

an umbrella cloth fastened between said tapered contracting cylinder and said fixing member;

a controlling tube, the top portion thereof being a spoke hub, the lower portion thereof being an expansion, inside of which there is provided an inner tube with several holes longitudinally arranged in line;

a main stem provided within said contracting cylinder and controlling tube;

a controlling lever within the lower portion of said main stem, having a top projecting piece, an interim projecting piece and a push button; and a set of spokes radially pivoted upon said spoke hub;

a spring provided behind said controlling lever inside said main stem;

being characterized in that on the one hand, in a case where said improved automatic umbrella in collapsed position is to be propped open, press said push button and then said coil spring compressed will furnish a downward pressure upon said spoke hub to unfold said umbrella cloth and said interim projecting piece will project into one of said holes of said inner tube; on the other hand, while said improved automatic umbrella in open position is to be folded up, longitudinally push forward said expansion of said controlling tube and then the outward divergent inside surface of said expansion of said tapered contracting cylinder will proceed the collection of said spokes therein and, until said top projecting piece projects rightly under the bottom of said expansion of said controlling tube, said improved automatic umbrella will stay in a collapsed position.

2. The automatic umbrella defined in claim 1 further including a female screw on said contrasting cylinder.

3. The automatic umbrella defined in claim 2 further including a male screw attached to said female screw.

4. The automatic umbrella defined in claim 1 wherein said fixing member includes elastic material.

5. The automatic umbrella defined in claim 1 wherein said contracting cylinder uppermost portion is thicker than said contracting cylinder lower portion.

* * * * *